US009163479B2

(12) United States Patent
Rogers et al.

(10) Patent No.: US 9,163,479 B2
(45) Date of Patent: Oct. 20, 2015

(54) FLAPPER OPERATING SYSTEM WITHOUT A FLOW TUBE

(75) Inventors: Rion R. Rogers, Tulsa, OK (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 2431 days.

(21) Appl. No.: 11/833,316

(22) Filed: Aug. 3, 2007

(65) Prior Publication Data

US 2009/0032238 A1 Feb. 5, 2009

(51) Int. Cl.
*E21B 34/00* (2006.01)
*E21B 34/06* (2006.01)

(52) U.S. Cl.
CPC ..... *E21B 34/066* (2013.01); *E21B 2034/005* (2013.01)

(58) Field of Classification Search
CPC ..... E21B 2034/005; E21B 34/066; Y10T 137/7876; Y10T 137/7877; Y10T 137/7898; Y10T 137/7902; Y10T 137/86936; Y10T 137/86944; Y10T 137/88038
USPC ..... 137/527, 527.36, 522, 523, 527.6, 629, 137/630, 614.18; 251/65, 129.01; 166/66.5, 166/332.8, 66.6; 175/318
See application file for complete search history.

(56) References Cited

U.S. PATENT DOCUMENTS 2,812,821 A * 11/1957 Nelson ..... 166/325
3,016,914 A * 1/1962 Keithahn ..... 137/527
3,582,038 A 6/1971 Harbonn et al.
3,602,250 A * 8/1971 Neenan ..... 251/65
3,731,742 A 5/1973 Sizer et al.
4,083,245 A 4/1978 Osborn
4,269,225 A 5/1981 Ruchser et al.
4,345,620 A 8/1982 Ruchser et al.
4,407,329 A 10/1983 Huebsch et al.
4,408,634 A * 10/1983 Peacock ..... 137/630.12
4,415,036 A * 11/1983 Carmody et al. ..... 166/324
4,458,945 A 7/1984 Ayler et al.
4,463,773 A 8/1984 Kojima et al.
4,478,286 A * 10/1984 Fineberg ..... 166/324
4,708,163 A 11/1987 Deaton (Continued)

FOREIGN PATENT DOCUMENTS

EP 1236862 A2 9/2002
WO 9857029 A1 12/1998

(Continued)

OTHER PUBLICATIONS

Vinzant, Mike, et al., "A Unique Design for Deep-Set Tubing Retrievable Safety Valves Increases Their Integrity in Ultra Deepwater Applications", SPE 90721, Sep. 1-9, 2004.

(Continued)

*Primary Examiner* — Craig Schneider
*Assistant Examiner* — Craig J Price
(74) *Attorney, Agent, or Firm* — Steve Rosenblatt

(57) ABSTRACT

A subsurface safety valve features no flow tube to operate the flapper and optionally an equalizing valve in the flapper, if used. It relies on magnetic force that is selectively created to draw the flapper to the open position. A torsion spring can close the valve when the field is removed. Optionally, the fields can be set up to pull and push the flapper open or to do either one. The optional equalizer valve can also be operated by a force field, preferably magnetic.

12 Claims, 1 Drawing Sheet

(56) References Cited

U.S. PATENT DOCUMENTS

| | | | | |
|---|---|---|---|---|
| 4,926,945 | A * | 5/1990 | Pringle et al. | 137/522 |
| 5,113,901 | A * | 5/1992 | Young | 251/65 |
| 5,152,316 | A | 10/1992 | Dorr | |
| 5,156,372 | A * | 10/1992 | Conrad | 251/65 |
| 5,209,454 | A * | 5/1993 | Engdahl et al. | 251/65 |
| 5,284,316 | A * | 2/1994 | Chen | 251/65 |
| 5,307,699 | A * | 5/1994 | Engdahl et al. | 251/65 |
| 5,465,786 | A | 11/1995 | Akkerman | |
| 5,787,417 | A | 7/1998 | Hargrove | |
| 6,032,734 | A | 3/2000 | Telfer | |
| 6,079,497 | A * | 6/2000 | Johnston et al. | 166/332.8 |
| 6,085,772 | A | 7/2000 | McGill et al. | |
| 6,112,764 | A * | 9/2000 | Engdahl et al. | 251/65 |
| 6,568,424 | B1 * | 5/2003 | Galad et al. | 251/65 |
| 6,568,470 | B2 * | 5/2003 | Goodson et al. | 251/129.01 |
| 6,619,388 | B2 | 9/2003 | Dietz et al. | |
| 6,926,089 | B2 | 8/2005 | Goodson, Jr. et al. | |
| 6,938,634 | B2 | 9/2005 | Dewey, Jr. | |
| 7,108,073 | B2 | 9/2006 | Patel | |
| 7,204,313 | B2 * | 4/2007 | Williams et al. | 166/324 |
| 7,213,653 | B2 | 5/2007 | Vick, Jr. | |
| 7,703,532 | B2 * | 4/2010 | O'Malley et al. | 166/332.8 |
| 2002/0023759 | A1 | 2/2002 | Deaton | |
| 2002/0066574 | A1 | 6/2002 | Leismer et al. | |
| 2004/0055752 | A1 | 3/2004 | Restarick et al. | |
| 2004/0060704 | A1 | 4/2004 | Layton et al. | |
| 2005/0087335 | A1 | 4/2005 | Vick | |
| 2006/0138372 | A1 | 6/2006 | Haedicke et al. | |
| 2007/0181312 | A1 | 8/2007 | Kritzler et al. | |
| 2008/0157014 | A1 * | 7/2008 | Vick et al. | 251/65 |

FOREIGN PATENT DOCUMENTS

| | | |
|---|---|---|
| WO | 0004274 | 1/2000 |
| WO | 2004029409 A1 | 4/2004 |
| WO | 2007003597 A1 | 1/2007 |

OTHER PUBLICATIONS

Vinzant, Mike, et al., "Enhanced Reliability with Unique Tubing-Retrievable Safety Valve Design", SPE 88627, Oct. 1-7, 2004.

Heijnen, W.H.P.M, et al., "Subsurface Safety Valve Developments for Gaswells", SPE 19283/1, Sep. 1989, 6 pages.

* cited by examiner

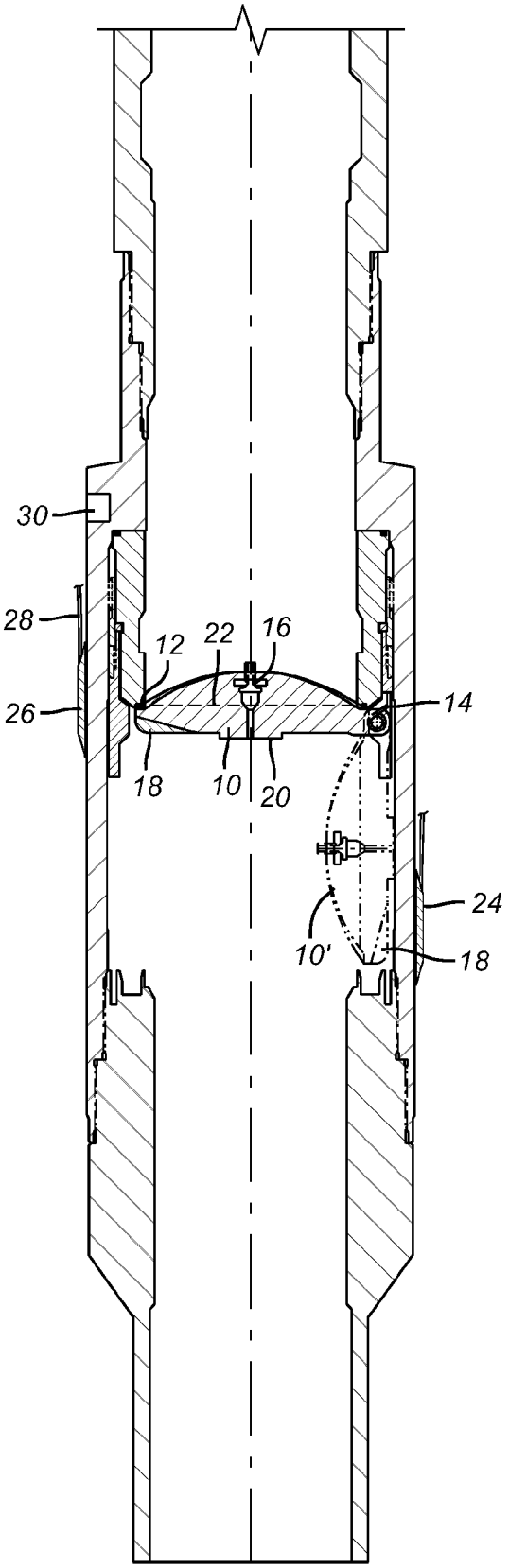
30
28
26
12
22
16
14
18
10
20
24
10'
18

FLAPPER OPERATING SYSTEM WITHOUT A FLOW TUBE

FIELD OF THE INVENTION

The field of this invention is subsurface safety valves for downhole use and more particularly operating systems for the flapper that do not employ a flow tube.

BACKGROUND OF THE INVENTION

Subsurface safety valves are emergency device that shut in a well. They are typically an integrated portion of a production string and are actuated through one or more control lines that run parallel to the production conduit in the surrounding annular space. Typically, these valves require pressure in the control line to hold the valve open and the valve closes on loss of or removal of control line pressure. These valves have a hinged valve member called a flapper that can pivot from being on a seat to define the valve closed position to being rotated off the seat to define the valve open position. Typically the control lines lead to an operating piston in the valve housing and that operating piston is linked to a flow tube that is biased by a closure spring. Applied control line pressure pushes the operating piston and takes the flow tube with it against the force of the closure spring. When the flow tube is forced down, it contacts the flapper that is then on the seat and rotates the flapper 90 degrees as it moves in front of the flapper so that flow can occur through the bore in the flow tube. The hinge for the flapper is biased by a torsion spring. When control line pressure is removed or lost, the closure spring releases its stored energy and pushes up the flow tube allowing the torsion spring to rotate the flapper back to its seat for the valve closed position.

Attempts in the past have been made to use alternatives to the above described basic design. One design features a separation of the control line pressure system from tubing pressure in the string, usually accomplished by resilient seals on the operating piston, by totally isolating the operating piston from the flow tube with a wall in the housing. The operating piston carries a magnet and the flow tube is magnetic with the theory being that movement of the magnet with the operating piston will urge the flow tube to operate the flapper and eliminate leak paths between the tubing and the hydraulic control system. This design is shown in U.S. Pat. No. 7,213,653.

Another design hooks the flow tube to an extending rod that is part of a solenoid type system that draws the rod into the valve body when a field is created therein from energizing a coil. This design is shown in U.S. Pat. No. 6,619,388.

Other multi-valve systems that can be separately functioned by a variety of ways including electromagnetic telemetry are described in U.S. Pat. No. 7,108,073.

What is needed and not found in the prior art is an operating system for a flapper that eliminates the need for a flow tube and associated hydraulic lines to the surface. The proposed system uses magnetic forces that can be selectively turned on and off to actuate rotation of the flapper. The torsion spring can preferably remain on the flapper hinge but its use is optional with the system. The magnetic field can be set up to either pull or push or both pull and push the flapper off its seat. Optionally, an equalizing valve in the flapper can be provided that initially responds to a magnetic opening force to equalize pressure before enough force is developed to pull the flapper off the seat. These and other features of the present invention will be more apparent to those skilled in the art from the description of the preferred embodiment and associated drawing that appear below, while recognizing that the scope of the invention is defined by the appended claims.

SUMMARY OF THE INVENTION

A subsurface safety valve features no flow tube to operate the flapper and optionally an equalizing valve in the flapper, if used. It relies on magnetic force that is selectively created to draw the flapper to the open position. A torsion spring can close the valve when the field is removed. Optionally, the fields can be set up to pull and push the flapper open or to do either one. The optional equalizer valve can also be operated by a force field, preferably magnetic.

BRIEF DESCRIPTION OF THE DRAWING

FIG. 1 is a section view of the valve in two positions showing the positioning of the magnetic field source or sources.

DETAILED DESCRIPTION OF THE PREFERRED EMBODIMENT

FIG. 1 shows a flapper 10 in the closed position against a seat 12. It also shows the same flapper 10' in the wide open position and rotated about 90 degrees from the closed position. The flapper 10 is pivotally mounted on a combination shaft and torsion spring represented schematically as 14. The torsion spring is preferred but can be omitted, as will be explained below. The flapper has an equalizing valve 16 that is shown schematically. It features a valve member that is movable in response to an applied force field, preferably magnetic. The use of an equalizer valve is also an option as some applications do not require its presence.

The flapper 10 preferably has a ferromagnetic material 18 preferably disposed adjacent its outer periphery and on its underside 20. The material 18 can be a contiguous piece or several pieces retained by or attached to the flapper 10. The ferromagnetic material can be on the top surface 22 in addition to the bottom surface 20. Alternatively, the majority or the entirety of the flapper can be ferromagnetic or constructed in a way so as to maximize the force to the flapper 10 from the applied force field to it. In the preferred embodiment the field that is applied is magnetic with an electromagnet 24 positioned close to the material 18 when the flapper 10' is in the open position. Another electromagnet 26 can be optionally used and preferably located 180 degrees around the valve housing and uphole of the flapper 10 in the closed position. Electromagnet 24, which can be used with or without electromagnet 26, is designed to attract material 18 so that when energized, it pulls the flapper 10 to the open or 10' position. To augment that force, electromagnet 26 can have the opposite polarity so that it repels material 18 no matter where on the flapper it is located. In this manner the flapper 10 when going to the 10' position can be pushed and pulled at the same time. The polarity on both magnets or on one if only one is used, can be reversed to start the flapper moving toward the closed position, with or without a torsion spring schematically shown as 14.

Optionally, if an equalizer valve 16 is used, it too can be urged to open using a force field preferably magnetic. Since the valve member in the equalizer valve has less mass than the flapper 10 that supports it, the equalizer valve flapper will move first to equalize differential across the closed flapper 10 before the flapper 10 is urged to move. By first equalizing pressure, the force required to open the flapper is dramatically reduced in some applications. The design of the equalizer valve is known with the difference being that instead of a flow tube pushing a plunger in the equalizer valve directly, the force field moves the plunger to get the same result.

Those skilled in the art can appreciate that the flow tube is not used and the flapper is actuated indirectly by a force preferably from a magnetic field. As used here, "indirectly" means without physical force transmitted by direct contact. By the same token, if an equalizer valve is used, it too is not actuated by the flow tube and is also moved indirectly by a force preferably a magnetic field. The force can pull or/and push the flapper or the equalizer to get movement in either direction. The flapper can have a ferromagnetic component on one side or both sides or can be made substantially or entirely from a ferromagnetic material. The torsion spring on the flapper pivot can be optionally omitted but should remain in the preferred embodiment. Power to the magnets 24 and 26 can come from a cable 28 that runs adjacent to the tubular string or from a self contained power source 30 that can be hard wired to the surface for signaling purposes or can be wirelessly triggered in a variety of techniques known in the art.

The above description is illustrative of the preferred embodiment and many modifications may be made by those skilled in the art without departing from the invention whose scope is to be determined from the literal and equivalent scope of the claims below.

We claim:

1. A subsurface safety valve for a subterranean location accessible from a surface, comprising:

a body having a single passage therethrough and a seat surrounding said passage, said body having end connections and said body being positioned at the subterranean location with a tubular string connected to at least one of said end connections to conduct fluids through said passage in opposed directions between the subterranean location to the surface;

a flapper movably mounted without a flow tube for at least one of selective opening of said passage by moving away from said seat and closing of said passage by moving into contact with said seat as a result of an indirectly applied force;

said flapper supported in said body such that the flapper weight urges said flapper away from said seat;

said indirectly applied force is at least one force field;

said field is magnetic;

said field pushes said flapper from said seat.

2. A subsurface safety valve for a subterranean location accessible from a surface, comprising:

a body having a single passage therethrough and a seat surrounding said passage, said body having end connections and is positioned at the subterranean location with a tubular string connected to at least one of said end connections to conduct fluids through said passage in opposed directions between the subterranean location to the surface;

a flapper movably mounted without a flow tube for at least one of selective opening of said passage by moving away from said seat and closing of said passage by moving into contact with said seat as a result of an indirectly applied force;

said flapper supported in said body such that its weight urges said flapper away from said seat;

said indirectly applied force is at least one force field;

said field is magnetic;

said field pulls said flapper from said seat;

said field pushes said flapper from said seat.

3. A subsurface safety valve for a subterranean location accessible from a surface, comprising:

a body having a single passage therethrough and a seat surrounding said passage, said body having end connections and said body being positioned at the subterranean location with a tubular string connected to at least one of said end connections to conduct fluids through said passage in opposed directions between the subterranean location to the surface;

a flapper movably mounted without a flow tube for at least one of selective opening of said passage by moving away from said seat and closing of said passage by moving into contact with said seat as a result of an indirectly applied force;

said flapper supported in said body such that the flapper weight urges said flapper away from said seat;

said indirectly applied force is at least one force field;

said field is magnetic;

said body comprises at least one electromagnet.

4. The valve of claim 3, further comprising:

a wired connection from the surface to selectively power said electromagnet.

5. The valve of claim 3, wherein:

said electromagnet can have a polarity reversed to a force direction applied to said flapper.

6. The valve of claim 5, further comprising:

a hard wired or wireless signal transmission to said electromagnet for selectively reversing said polarity.

7. A subsurface safety valve for a subterranean location accessible from a surface, comprising:

a body having a single passage therethrough and a seat surrounding said passage, said body having end connections and said body being positioned at the subterranean location with a tubular string connected to at least one of said end connections to conduct fluids through said passage in opposed directions between the subterranean location to the surface;

a flapper movably mounted without a flow tube for at least one of selective opening of said passage by moving away from said seat and closing of said passage by moving into contact with said seat as a result of an indirectly applied force;

said flapper supported in said body such that the flapper weight urges said flapper away from said seat;

a torsion spring on a pivot for said flapper to directly apply a force to it toward said seat.

8. A subsurface safety valve for a subterranean location accessible from a surface, comprising:

a body having a single passage therethrough and a seat surrounding said passage, said body having end connections and is positioned at the subterranean location with a tubular string connected to at least one of said end connections to conduct fluids through said passage in opposed directions between the subterranean location to the surface;

a flapper movably mounted without a flow tube for at least one of selective opening of said passage by moving away from said seat and closing of said passage by moving into contact with said seat as a result of an indirectly applied force;

said flapper supported in said body such that its weight urges said flapper away from said seat;

an equalizer valve on said flapper operated indirectly.

9. The valve of claim 8, wherein:

said equalizer valve is operated to open before movement of said flapper away from said seat.

10. A subsurface safety valve, comprising:

a body having a single passage therethrough and a seat surrounding said passage;

a flapper movably mounted for selective opening of said passage by moving away from said seat and closing of said passage by moving into contact with said seat, said opening and closing accomplished using an indirect force acting on said flapper and without a flow tube;

an equalizer valve in said flapper movable as a result of an indirectly applied force that makes no physical contact with said equalizer valve.

11. The valve of claim 10, wherein:

said indirectly applied force is at least one force field.

12. The valve of claim 11, wherein:

said field is magnetic.

* * * * *